US008446929B2

(12) United States Patent
MacRae

(10) Patent No.: US 8,446,929 B2
(45) Date of Patent: May 21, 2013

(54) FURNACE REFRACTORY BRICK HEARTH SYSTEM

(76) Inventor: Allan J. MacRae, Hayward, CA (US)

( * ) Notice: Subject to any disclaimer, the term of this patent is extended or adjusted under 35 U.S.C. 154(b) by 1337 days.

(21) Appl. No.: 11/674,123

(22) Filed: Feb. 12, 2007

(65) Prior Publication Data

US 2008/0190336 A1 Aug. 14, 2008

(51) Int. Cl.

| | |
|---|---|
| ***F27D 1/00*** | (2006.01) |
| ***F23M 5/02*** | (2006.01) |
| ***C21C 5/44*** | (2006.01) |

(52) U.S. Cl.

USPC ..... 373/72; 110/336; 110/338; 110/340; 266/285; 266/286

(58) Field of Classification Search

USPC ..... 372/76, 113; 266/286, 268, 285; 110/336–338, 340; 373/76, 113, 71, 72, 75, 373/163, 720

See application file for complete search history.

(56) References Cited

U.S. PATENT DOCUMENTS

| | | | | |
|---|---|---|---|---|
| 3,175,961 | A * | 3/1965 | Olsen | 202/223 |
| 3,399,267 | A * | 8/1968 | Renkey et al. | 373/164 |
| 4,773,630 | A | 9/1988 | Carninati | |
| 4,923,397 | A * | 5/1990 | Nassetti | 432/251 |
| 5,108,572 | A | 4/1992 | Lathion | |
| 5,648,981 | A * | 7/1997 | Miner et al. | 373/74 |
| 5,867,523 | A | 2/1999 | Wasmund et al. | |
| 6,814,012 | B2 | 11/2004 | MacCaffrey et al. | |
| 6,911,176 | B2 | 6/2005 | Saarinen | |
| 2004/0069192 | A1 * | 4/2004 | McCaffrey et al. | 110/336 |
| 2006/0196399 | A1 * | 9/2006 | McCaffrey et al. | 110/336 |

OTHER PUBLICATIONS

T. Ma, et al., Recent Developments in DC Furnace Design, symposium paper presented in Montreal, Candada, Aug. 1999.

* cited by examiner

*Primary Examiner* — Henry Yuen
*Assistant Examiner* — Hung D Nguyen
(74) *Attorney, Agent, or Firm* — Richard B. Main; Main Law Firm

(57) ABSTRACT

A brick hearth system includes a rigid containment shell in which a concave bottom is lined with a hearth refractory sub-layer and hearth brick working layer. The outer perimeter of the hearth refractory is ringed with thrust blocks to compress the whole toward the center and to thereby deny gaps from forming between the separate bricks. Many individual thrust rods penetrate the outer bottom of the containment shell, and such are used to transmit compression forces generated outside the shell to be applied against the thrust blocks in unison. Each thrust rod receives an adjustable amount of inward force from a spring, acting either directly or through a beam or rocker arm. These are anchored to and use the hoop strength of the containment shell as leverage. As the hearth brick working layer grows during its service life, the ring of thrust blocks grows in diameter as well inside the margins provided within the containment shell. The individual thrust rod springs are periodically adjusted to keep the pressures in the optimal range.

8 Claims, 4 Drawing Sheets

FURNACE REFRACTORY BRICK HEARTH SYSTEM

BACKGROUND

1. Field of the Invention

The present invention relates to pyrometallergical furnaces for the smelting, converting, or melting of concentrates, mattes, or metals, and more particularly to methods and devices for applying and maintaining proper compression of the brick hearth in a furnace refractory so as to extend its service life.

2. Description of the Prior Art

Layers of refractory bricks inside a tub-like shell are needed to cover the floor interior with a hearth sub-layer and brick hearth working layer, and to line the interior of the walls. The refractory brick layers inside the steel shell can withstand the very high operating temperatures, and the shell provides the necessary containment and support.

Some so-called flexible shells are constructed with adjoining plates that are bound together. The loose plate construction can accommodate some growth in the hearth bricks that occurs as the bricks each slowly absorb molecules of metal over their operational lifetimes. The conventional means of binding the shell plates together, and that maintain a correct compressive force on the bricks to keep them tight, are usually very complex and expensive. The other type of shell, of interest herein, is constructed as a single rigid piece that will remain one size, and needs no such plate binding mechanisms. But the conventional ways used to keep the hearth bricks together under the right pressures for rigid shells provide for only very limited growth in the hearth brick before shutdown and replacement is required.

What is needed are methods and devices that can accommodate larger amounts of growth in the brick hearth, and that use the less expensive rigid shells to contain them.

SUMMARY OF THE INVENTION

Briefly, a brick hearth system embodiment of the present invention comprises a rigid containment shell in which a concave dished bottom is lined with a sub-layer and a working layer of hearth bricks. The outer perimeter of the hearth brick is ringed with thrust blocks to compress the whole radially toward the center and to thereby deny leaks from forming between the separate bricks. Many individual thrust rods penetrate the outer bottom of the containment shell, and such are used to transmit compression forces generated outside the shell to be applied inside against the thrust blocks in unison. Each thrust rod receives an adjustable amount of inward force from a spring, acting either directly or through a beam or rocker arm. These are anchored to and use the hoop strength of the containment shell as leverage. As the hearth bricks grow during their service life, the ring of thrust blocks grows too in diameter inside the margins provided within the containment shell. The individual thrust rod springs are periodically adjusted to keep the working pressures in an optimal range.

An advantage of the present invention is that replacement of the furnace hearth and the surrounding expansion material is less frequent compared to conventional systems.

Another advantage of the present invention is that a system is provided that reduces the rate of expansion of the furnace hearth by increasing the load on the furnace hearth.

A further advantage of the present invention is conventional containment shells can be modified so the thrust blocks and rods of the present invention can be readily installed and put to work.

A still further advantage of the present invention is that a system is provided such that a hearth binding system could also be installed on rectangular furnaces with flexible binding systems, which already incorporate buckstays, tie-rods and springs. The new additions would increase the hearth compression, and thereby reduce the rate of long term expansion due to penetration of the hearth by molten metals.

Another advantage is embodiments of the present invention allow much longer campaigns before a furnace must be shut down, its hearth brick replaced, and the hearth compression thrust rods reset. When retrofitted with embodiments of the present invention, conventional furnaces with campaign lives of two to four years should be able to double this time before they need to be shutdown for hearth maintenance.

A further advantage of the present invention is that overstressing of the furnace shell caused by hearth refractory expansion can be eliminated.

These and other objects and advantages of the present invention will no doubt become obvious to those of ordinary skill in the art after having read the following detailed description of the preferred embodiments which are illustrated in the various drawing figures.

IN THE DRAWINGS

FIG. 2A shows the use of a load beam, and FIG. 2B shows the use of rocker arms;

Figure 3:
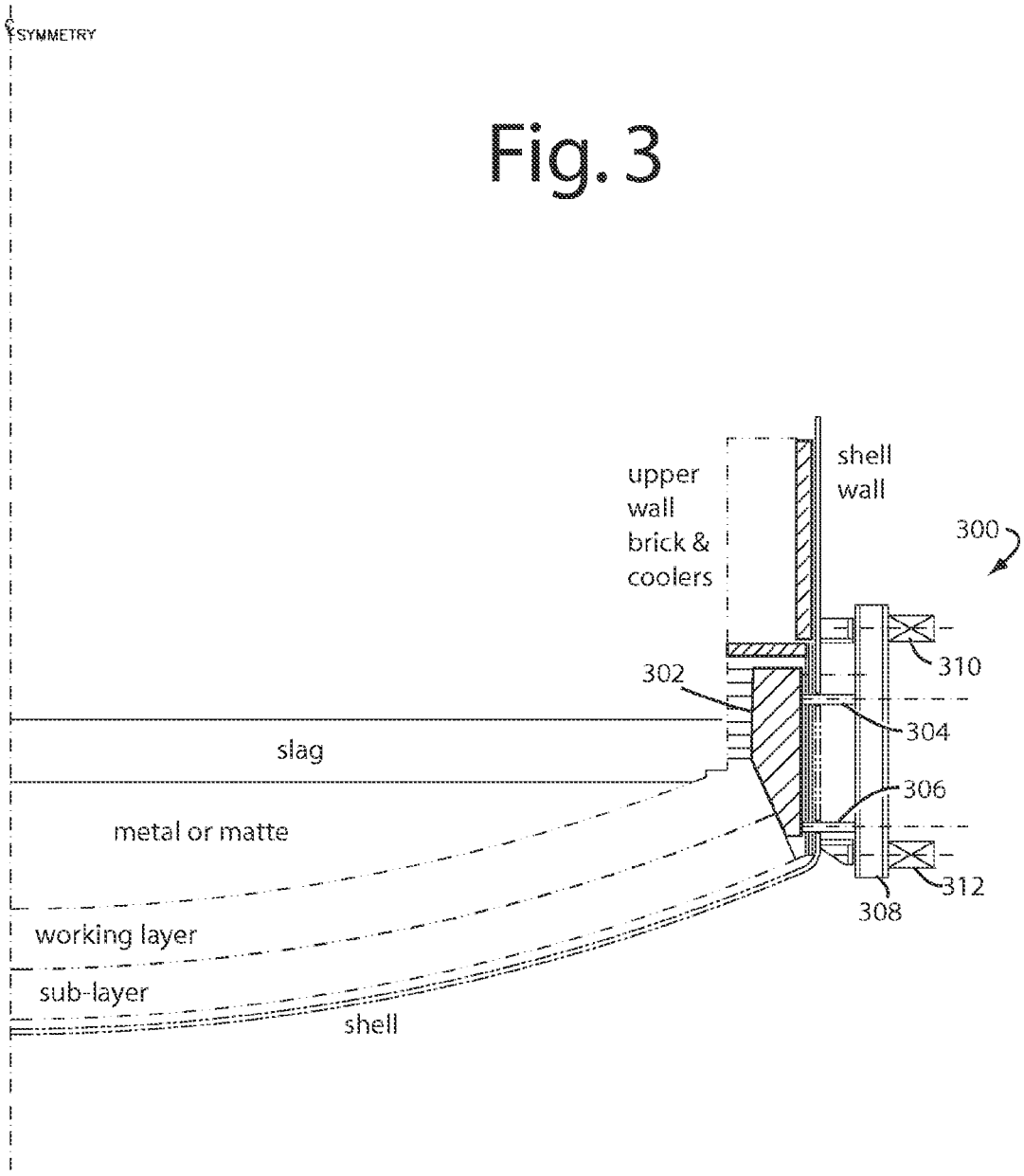
Figure 4:
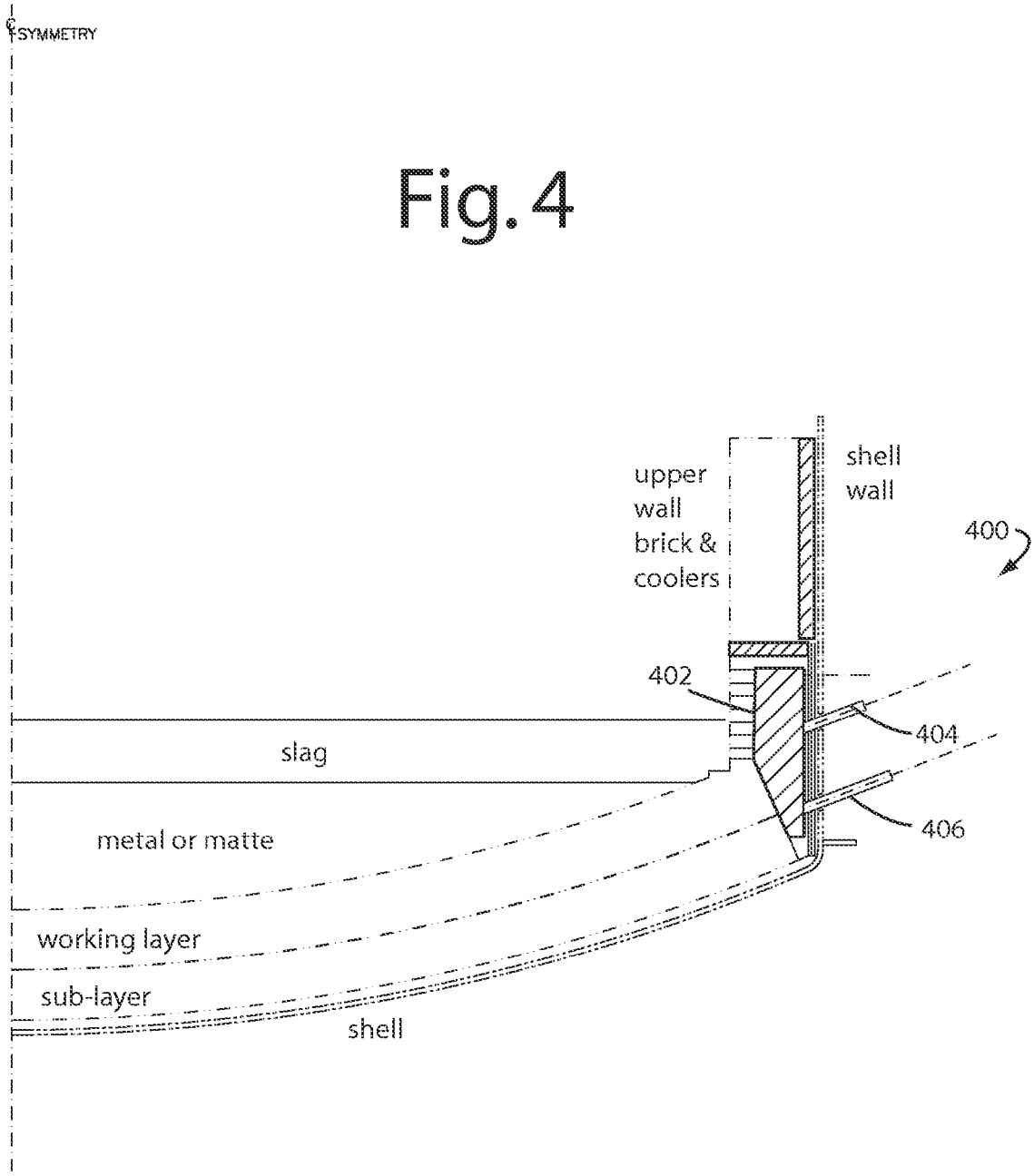

FIG. 3 is a cross sectional view of one thrust block embodiment of the present invention in which cooling is included and the thrust rods press radially inward normal to the axis of a circular furnace hearth; and FIG. 4 is a cross sectional view of another thrust block embodiment of the present invention in which cooling is included and the thrust rods press radially inward inline with the hearth brick working layer at the bottom of a circular furnace hearth.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 1:
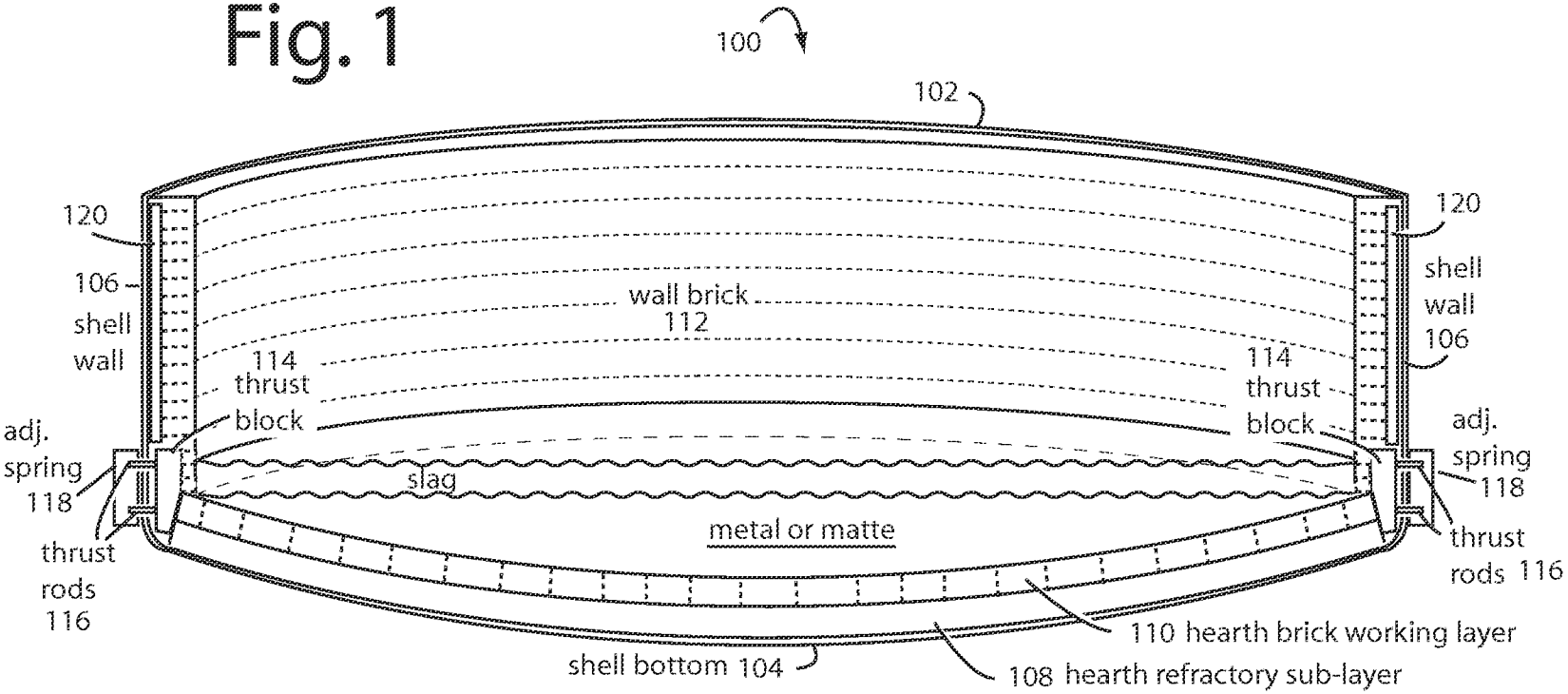
FIG. 1 is a cut-away perspective view diagram of a circular refractory furnace hearth system embodiment of the present invention showing how a perimeter ring of thrust blocks inside the containment shell can be pressed inwardly against the outer edges of the hearth brick working layer using thrust rods and externally mounted adjustable spring sets.

FIG. 1 represents a furnace refractory brick hearth system embodiment of the present invention, and is referred to herein by the general reference numeral 100. The system 100 comprises an outer, rigid steel containment shell 102 having a dished bottom 104 and circular vertical walls 106. The bottom is lined with hearth refractory in one or more sub-layers like sub-layer 108, over which is placed a hearth brick working layer 110. Such hearth refractory may comprise individual bricks.

The outer perimeter of the hearth brick working layer 110 supports a wall brick 112. Gravity keeps the wall brick 112 tightly packed, and a ring of thrust blocks 114 inwardly compress and compact the hearth brick working layer 110. The radial compression towards the center is provided by many individual thrust rods 116 that each push inwardly against corresponding thrust blocks 114. The thrust rod forces are provided externally by adjustable spring assemblies 118 mounted on the outside of the shell wall 106. Simple holes, or pushrod guides may be provided for the thrust rods in the containment shell 102. The adjustable spring assemblies 118 take advantage of the hoop strength and solid construction of the shell wall 106 to generate the necessary leverage.

In operation, the adjustable spring assemblies 118 are periodically set to a predetermined pressure value. The hearth brick working layer 110 will inevitably grow in diameter as molecules of molten metal are absorbed into the refractory brick material and the minute spaces between them. Such growth necessitates routine readjustment of the adjustable spring assemblies 118, and so the conditions should be monitored.

Initially, a relatively wide margin of space is provided between the outer edges of the thrust blocks 114 and the inside of shell wall 106. Such can be filled with expansion boards or other crushable material that can be replaced or removed as the space diminishes. Fill material such as this is not required if a spring system embodiment of the present invention is sized to carry the full hearth load.

In some embodiments of the present invention, the thrust blocks 114 are provided with circulating coolant to draw off heat, and may be made of copper alloy. A wall cooler 120 may also be provided which has horizontally or vertically oriented layers. The thrust block 114 is intended to either replace the brick skew, or apply load directly to it. The thrust blocks, as shown in FIGS. 1, 3 and 4, rise from the brick skew to the top of the molten bath. Alternatively, it could be kept shorter to the top of the brick skews, e.g., to keep all the brick within the bath horizontally tight. The possibility of leaks developing between wall brick and the skews would thereby be eliminated. The shapes of the thrust blocks shown in FIGS. 1-4 are merely exemplary, and should not be understood as limiting the range of useful variations.

The typical commercial furnace hearth size ranges from two to twelve meters in diameter. The radial spacing of the hearth compression thrust rods 116 depends on the forces required, the stiffness of the inside thrust blocks 114, and should be arranged to avoid interference with tap holes and other openings. As an example, the spacing could be expected to range from one to two meters for larger diameter furnaces, or they could be arranged at 10-30 degree increments around the furnace shell 102.

Thrust rods 116 would generally be fabricated from steel, but may need to be made from metals that can resist corrosion and/or assist in cooling. The size and cross sectional shapes needed for the thrust rods 116 depend on the engineered forces required. Other contributing forces increase with the size of the hearth refractory, as well as the fluid pressure coming from the top of the hearth. The maximum fluid pressures will be observed at the hearth invert, or the lowest point of the hearth.

The devices could be used to impart initial compression of the hearth, which could result in an initial net shrinkage. The devices could be designed to typically accommodate 50-150 mm of hearth expansion. On a percentage basis, up to practical maximum of two percent of the hearth diameter. For larger hearth movements, differential expansion between the wall and the hearth becomes unmanageable, and the required size of the compression rods becomes unreasonable.

The minimum compression forces on the hearth refractory brick must be sufficient to keep interfacial pressures between the bricks greater than the fluid pressures trying to come between or float the bricks. One object is to limit penetration of molten metal, matte or slag that gets into the joints. Too rapid a penetration can induce a quicker than normal rate of expansion of the hearth over the long term. Too much molten metal penetration that gets under the bricks can cause individual bricks and sections of brick hearth to try to separate and float to the top of the matte. So, the hearth compression forces applied must be sufficient to maintain hearth stability, and overcome large buoyancy pressures if molten metals nevertheless get beneath the hearth brick working layer 110.

When embodiments of the present invention supply sufficient hearth compression to maintain hearth stability, and apply the minimum compression needed to limit melt penetration between the joints, their long-term hearth refractory rate-of-growth will not exceed that observed in conventional current hearth designs. And the service life will be greatly increased at very modest cost.

The rate of hearth expansion has been shown to be reduced with good hearth compression. Hence, increasing hearth compression could be used to reduce hearth expansion. With existing hearth designs that use expansion boards between the skews and vertical shell plates, hearth expansion can be one to two millimeters (mm) after initial heat up. This may decrease to 0.5-1.0 mm as the expansion material is compressed. In usual practice, the expansion material must be replaced prior to the shell becoming overstressed.

Corrosion can be an issue in those environments where corrosive gases are produced as part of the smelting process. Gases like $SO_2$ and $SO_3$ can readily form acids. Acid environments necessitate the use of stainless steel or nickel alloys to resist corrosion.

Parts that may be exposed to high heat loads or molten materials may require cooling. If a component is to be cooled, it may be fabricated from a conductive alloy of copper or other metal, to minimize stresses and to reduce the potential for cracking. For example, the internal member used for distributing the compressive forces to the hearth may be cooled with air, water or other heat transfer fluid or gas; it may have internal cooling passages for conveying the heat transfer fluid or gas.

Figure 2A:
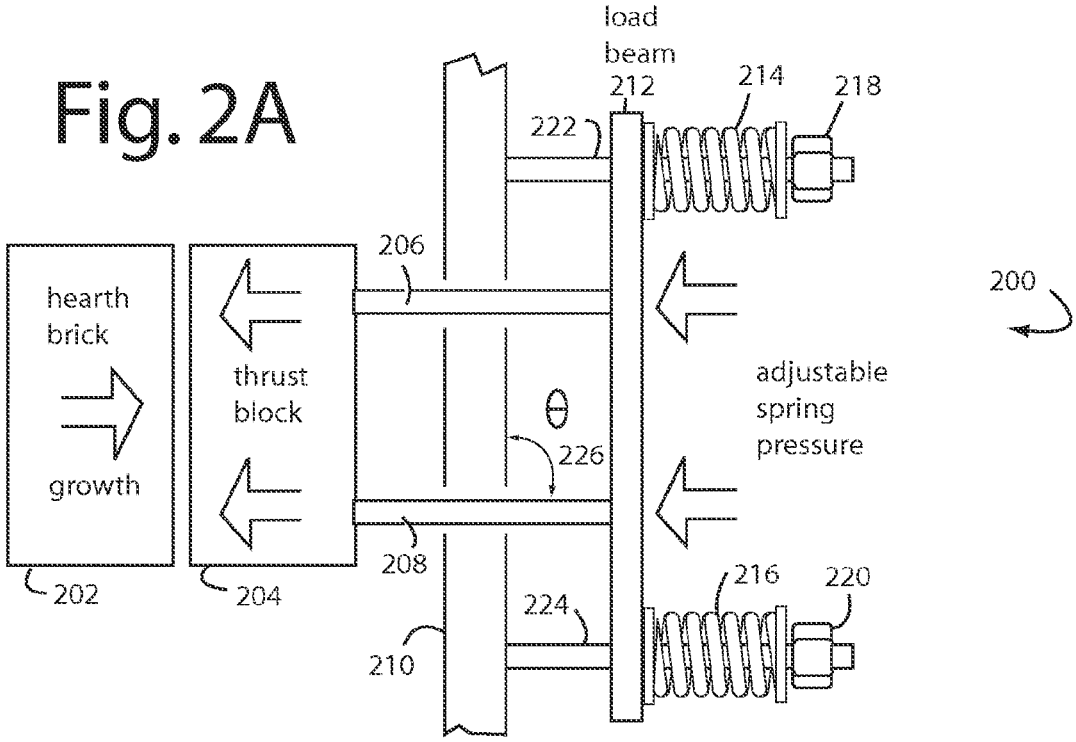
FIGS. 2A and 2B are diagrams showing how spring pressure can be coupled from the outside of the containment shell through to the inside using thrust rods that push in against the ring of thrust blocks around the hearth brick working layer.
Figure 2B:
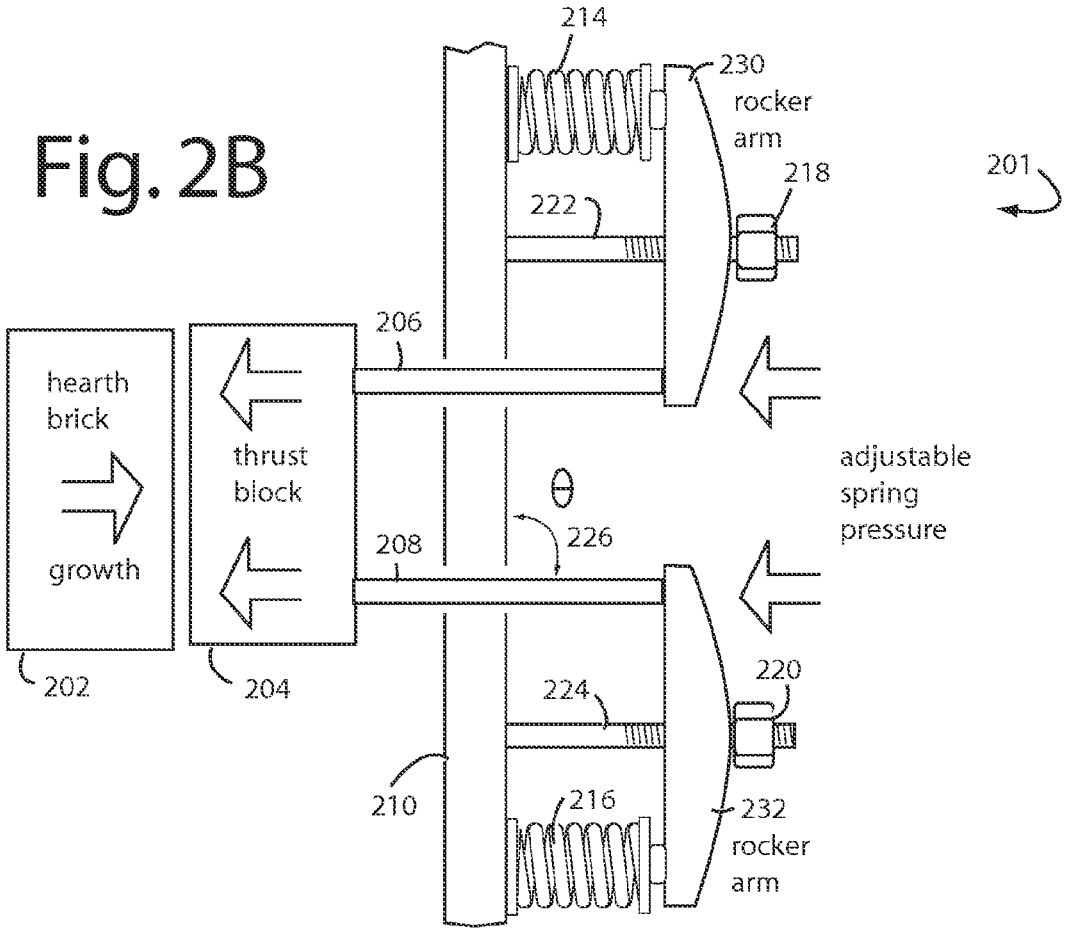

FIGS. 2A and 2B show two slightly different configurations 200 and 201 to couple spring pressure from the outside of the containment shell through to the inside using thrust rods that push in against the ring of thrust blocks around the hearth brick working layer. In FIG. 2A, configuration 200 makes use of a load beam, and in FIG. 2B, configuration 201 uses rocker arms.

In both FIGS. 2A and 2B, a hearth brick working layer 202 grows and presses outwardly against a ring of thrust blocks 204. A number of thrust rods 206 and 208 pass through the outer wall of a containment shell 210 and will transmit inwardly directed pressures.

In FIG. 2A, a load beam 212 bridges over the ends of thrust rods 206 and 208 and presses against them using springs 214 and 216, and adjustment nuts 218 and 220, mounted on external studs 222 and 224.

The inward forces generated by the springs 214 and 216 are directed at an angle theta (θ) 226, e.g., 90-degrees to the central vertical axis of the furnace, or at some appropriate obtuse or acute angle relative to the shell wall 210 to put them inline with the outer edges of a dished bottom hearth brick working layer.

FIG. 2B shows the use of a pair of rocker arms 230 and 232. The studs 222 and 224 allow adjusting nuts 218 and 220 to act as fulcrums.

Adjusting nuts 218 and 220 are set at the beginning, and then reset during the service life of hearth brick working layer 202 as it grows. The amount of pressure applied by particular springs can be interpreted from compression charts according to their present compressed spring height. Other mechanisms could also be used to estimate thrust rod pressures to keep the furnace in proper tune.

FIG. 3 shows a horizontal-type thrust block system embodiment of the present invention, and is referred to herein by the general reference numeral 300. A copper-alloy thrust block 302 has internal water jackets to circulate a coolant and a tapered edge to press square against a hearth brick working layer. A pair of thrust rods 304 and 306 are pressed radially inward normal to the vertical axis of a circular furnace hearth by a spreader beam 308. Adjustments to the thrust rod forces can be made by a pair of tie-rod and spring sets 310 and 312.

FIG. 4 shows an angled-type thrust block system embodiment of the present invention, and is referred to herein by the general reference numeral 400. A copper-alloy thrust block 402 has internal water jackets to circulate a coolant and a tapered edge to press square against a hearth brick working layer. A pair of thrust rods 404 and 406 are pressed radially inward inline with the outer edges of a hearth brick working layer. Alternatively, thrust rod 404 or 406 could be horizontal while the other is inclined. The spring assemblies with rocker arms and/or spreader beams, as shown in FIGS. 2A, 2B, and 3, for example could be adapted for use.

Seals can be included around each thrust rod where it penetrates the furnace shell to control leakage. But, if the spring system is doing its job keeping the bricks tight, such seals would not be necessary.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A furnace refractory brick hearth system, comprising:

a vertically cylindrical, rigid steel, containment shell in which a bottom is lined on its interior with a hearth refractory sub-layer and a downwardly dished hearth brick working layer, and further comprising a solid shell wall with a hoop strength for leverage;

a ring of thrust blocks providing for radial inward compression of a whole outer perimeter of said hearth brick working layer toward a center and for closing gaps between separate bricks;

a plurality of individual radially spaced thrust rods around the entire circular perimeter that penetrate an outer bottom wall of the containment shell, and that enable a transmission of radially inward compression forces generated outside the containment shell to be applied in unison against the ring of thrust blocks; and a number of compression devices respectively connected to each thrust rod and providing for an adjustable amount of force to be inwardly applied through matching ones of the plurality of individual thrust rods to a corresponding thrust block in the ring of thrust blocks;

wherein, the ring of thrust blocks allows said hearth brick working layer to change in diameter inside margins provided within the containment shell while still maintaining a substantially constant compressive force that denies gap formation amongst separate bricks.

2. The hearth system of claim 1, wherein the compression devices are anchored to and use the hoop strength of the containment shell as leverage.

3. The hearth system of claim 1, wherein the compression devices allow for periodic adjustment to keep their pressures on said hearth brick working layer in an optimal range.

4. The hearth system of claim 1, further comprising:

a system of coolers included with each of the thrust blocks to absorb heat.

5. The hearth system of claim 1, wherein:

the thrust rods and thrust blocks are aligned to transmit inward radial compressive forces that are normal to the vertical axis of the hearth system.

6. The hearth system of claim 1, wherein:

the thrust rods and thrust blocks are aligned to transmit inward radial compressive forces that are normal to the faces between adjacent bricks in said downwardly dished hearth brick working layer, and inline with hearth thrusts.

7. The brick hearth system of claim 1, wherein:

the containment shell has at its bottom said sub-layer and said hearth brick working layers that form a concave bottom surface.

8. The brick hearth system of claim 1, further comprising:

a lining of refractory bricks on the inside walls of the containment shell, and bearing down on top of the ring of thrust blocks acting as a skew device.

* * * * *